United States Patent [19]

Brudnak, Jr.

[11] 3,978,597

[45] Sept. 7, 1976

[54] DRAFT SENSING ELEVATING SCRAPER WITH AUTOMATIC ELEVATOR SPEED CONTROL

[75] Inventor: Andrew Brudnak, Jr., Oak Lawn, Ill.

[73] Assignee: International Harvester Company, Chicago, Ill.

[22] Filed: Mar. 27, 1975

[21] Appl. No.: 562,624

Related U.S. Application Data

[63] Continuation-in-part of Ser. No. 470,706, May 16, 1974, abandoned.

[52] U.S. Cl. ..... 37/8; 172/4

[51] Int. Cl.[2] ..... B60P 1/36; A01B 41/06

[58] Field of Search ..... 37/8, 124, 126 R, 129 R, 37/DIG. 1, DIG. 14, DIG. 20; 172/4, 7–10; 91/43; 267/57

[56] References Cited

UNITED STATES PATENTS

| | | | |
|---|---|---|---|
| 3,064,371 | 11/1962 | Kutzler | 37/DIG. 1 |
| 3,239,013 | 3/1966 | Hanssmann | 172/10 |
| 3,246,702 | 4/1966 | Carlin | 172/10 |
| 3,275,085 | 9/1966 | Bunting et al. | 172/10 |
| 3,477,152 | 11/1969 | Ask | 37/129 |
| 3,484,960 | 12/1969 | Kokaly et al. | 37/8 |
| 3,520,369 | 7/1970 | Nicholson | 172/7 |
| 3,581,415 | 6/1971 | Campbell | 37/8 |
| 3,589,447 | 6/1971 | Seaberg | 172/10 X |
| 3,722,598 | 3/1973 | Peterson | 172/10 |
| 3,814,188 | 6/1974 | Ahne | 172/7 |

*Primary Examiner*—E. H. Eickholt

*Attorney, Agent, or Firm*—William H. Wendell; Floyd B. Harman

[57] ABSTRACT

A removal control system for a scraper having a tractor pivotally attached to a bowl, said bowl having a cutting blade attached thereto, an elevator pivotally mounted on said bowl, an engine and utilizing an elevator control system and a cutting depth control system either in combination or separately whereby the optimum removal rate is maintained during operation of said scraper. The elevator control system includes a variable speed drive mechanism operatively connected to said elevator and said engine for controlling the speed of said elevator, a motion sensing mechanism responsive to said elevator's pivotal motion for varying the speed of said variable speed drive mechanism, a connector operatively connecting said motion sensing mechanism and said variable speed drive mechanism, a speed selector arrangement operatively connected to said variable speed mechanism for establishing the optimum speed of said elevator and a linkage arrangement operatively connecting said variable speed drive mechanism and said selector arrangement. The cutting depth control system includes a position control mechanism operatively connected to said engine and a cutting blade adjustably mounted on said bowl for establishing the cutting depth of said blade, a draft sensing mechanism responsive to the cutting load on said scraper for varying the position of said position control mechanism, a coupling operatively connecting said draft sensing mechanism and said position control mechanism, a coupling operably connecting said draft sensing mechanism and said position control mechanism, a depth selector arrangement operably connected to said position control means for establishing the optimum cutting depth of said cutting blade and a lever arrangement operably connecting said depth selector mechanism and said position control mechanism.

4 Claims, 3 Drawing Figures

DRAFT SENSING ELEVATING SCRAPER WITH AUTOMATIC ELEVATOR SPEED CONTROL

CROSS REFERENCE TO RELATED APPLICATION

This application is a continuation in part of my application Ser. No. 470,706 filed May 16, 1974 now abandoned.

BACKGROUND OF THE INVENTION

This invention relates generally to material handling scrapers, and more particularly concerns scrapers which are responsive to blade draft load and elevator loads variations which occur during their operation.

The basic material handling scraper includes a tractor pivotally connected to a bowl with both being supported by wheels. The bowl is equipped with a cutting blade which separates earth from the terrain over which the scraper is moving. This blade is normally situated in the forward portion of the bowl with the support wheels being located in the rear portion of the bowl. There is normally a hydraulic connection by rams between the tractor and the bowl which is controlled by the operator to lower the bowl into engaging position with the material beneath the bowl. As the vehicle moves over the material, the cutting action of the blade and the forward motion of the vehicle force the separated material into the bowl. Upon loading the bowl to its full capacity the operator raises the bowl to permit transportion of the carried material to its unloading location.

The performance of the basic material handling scraper has been adversely affected in the past by the soil conditions in which it must operate. One major limitation to the efficient removal of material has been the constant adjustment which must be made by the operator to allow for uneven surface characteristics of the soil which it is removing. The operator must continually raise and lower the cutting blade to avoid slippage of the drive wheel, stalling of the engine or scalloping of the finished surface which can result from the depth variation of the soil surface and density of the material being removed. A second limitation to the effectiveness of the basic scraper also results from these variations in soil conditions which adversely affect the flow of separated material from the front of the bowl to the rear of the bowl thereby decreasing the effective moving capacity of the scraper.

The common method used to improve the loading characteristics of the bowl is the addition of an elevator mechanism which imputes a rearward and upward motion to the separated material. The normal mechanism of the elevator is a sprocket driven endless chain configuration with one sprocket being located above and forward of the cutting blade and the second sprocket being displaced rearwardly and upwardly from the first sprocket. The endless chain arrangement is conventionally supplied with power from a constant speed motor and is pivotally connected at its upper rearward sprocket to the bowl to allow for variations in the height of the material which has been separated by the blade. This elevator arrangement does provide improved loading of the bowl, but it is incapable of providing sufficient loading power to effective load the bowl when the rate of material separation exceeds the capacity of the constant speed drive system.

Accordingly, it is the primary aim of this invention to provide a system which maximizes the capacity and efficiency of a scraper during its loading operation.

With more particularity, it is an object of this invention to provide a scraper bowl which has a cutting blade with a depth control system that provides a constant removal load by making the depth of cut responsive to variations in the removal load.

Moreover, it is an object of this invention to provide a scraper with an elevator control system that utilizes the entire bowl material holding capacity by making the speed of the elevator responsive to variations in the volume of material that is dislodged during the scraping process.

Finally, it is an object of this invention to provide a removal system for a scraper which is responsive to the loading forces and volume of removed material to insure consistent removal loads and complete use of the bowl capacity.

SUMMARY OF THE INVENTION

In accordance with the invention there is provided a removal control system for a scraper having an engine for motor force and a tractor pivotally attached to a bowl with the system including a cutting depth control system and an elevator control system either in combination or separately. The cutting depth control system varies the position of the cutting blade which is attached to the bowl and includes a position control means operatively connected to the engine and the cutting blade for establishing the cutting depth of said blade, a depth sensing means responsive to the cutting load on said scraper for varying the position of said position control means, a coupling operably connecting said draft sensing means and said position control means, a depth selector means operably connected to said position control means for establishing the optimum cutting depth of said cutting blade and a lever arrangement operably connecting said depth selector means and said position control means. The elevator control system affects the operation of an elevator which is pivotally mounted on said bowl and includes a variable speed drive means operably connected to said elevator and said engine for controlling the speed of said elevator, a motion sensing means responsive to said elevators pivotal motion for varying the speed of said variable speed drive means, a connecting means operably connecting said motion sensing means and said variable speed drive means, a speed selector means operably connected to said variable speed drive means for establishing the optimum speed of said elevator and a linkage arrangement operably connecting said variable speed drive means and said selector means.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

Figure 1:
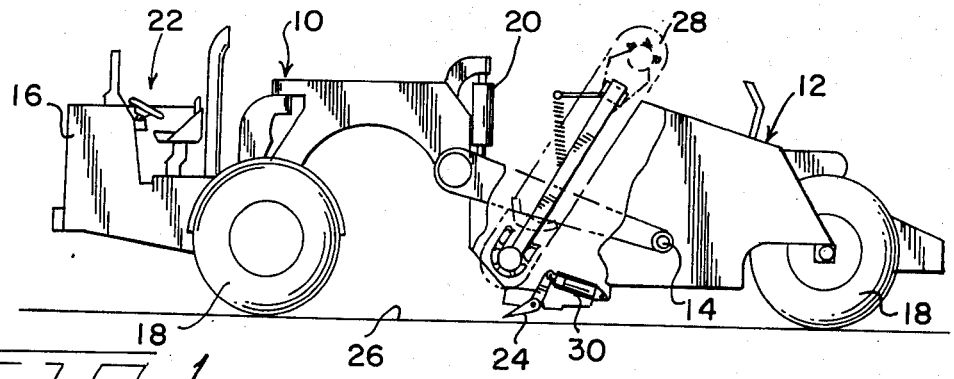
FIG. 1 is a side view of a scraper in transport mode with an adjustable cutting blade and an elevator depicted by breaking away the front section of the scraper bowl.

The environment of the invention is that of the material handling scraper whose function it is to remove large volumes of surface material from one location and transport it to another location. A common configuration for such a scraper is depicted in FIG. 1 which shows the tractor 10 pivotally connected to the bowl 12 at axis 14. The particular scraper shown in FIG. 1 has its engine 16 mounted in the tractor 10, but it is understood that the invention will also function in a scraper which has engines in both the tractor and in the bowl. The preferred embodiment's scraper has its tractor 10 and bowl 12 each supported by a pair of wheel assemblies 18 with the relative position of the tractor 10 and bowl 12 controlled by hydraulic jacks 20. The operator controls the position of the jacks 20 from his operator station 22 located in the forward section of the tractor 10.

Scraper vehicle depicted in FIG. 1 is in the transport mode with the cutting blade 24 positioned above the surface of the ground 26 by hydraulic jacks 20 being placed in their retracted position by the operator. The normal approach taken to improve the consistency of the cutting depth and the efficiency of filling the bowl is to add an elevator 28 to the bowl and to make the cutting blade 24 adjustable in its cutting angle by the addition of blade cylinder 30. The addition of these features to a basic scraper does improve its removal efficiency, but they also increase the control burden of the operator who must manually adjust their operation to compensate for variations in the ground conditions. The present invention eleviates this extra burden by providing a removal control system which is capable of controlling both the elevator and the cutting depth either separately or in combination.

Figure 2:
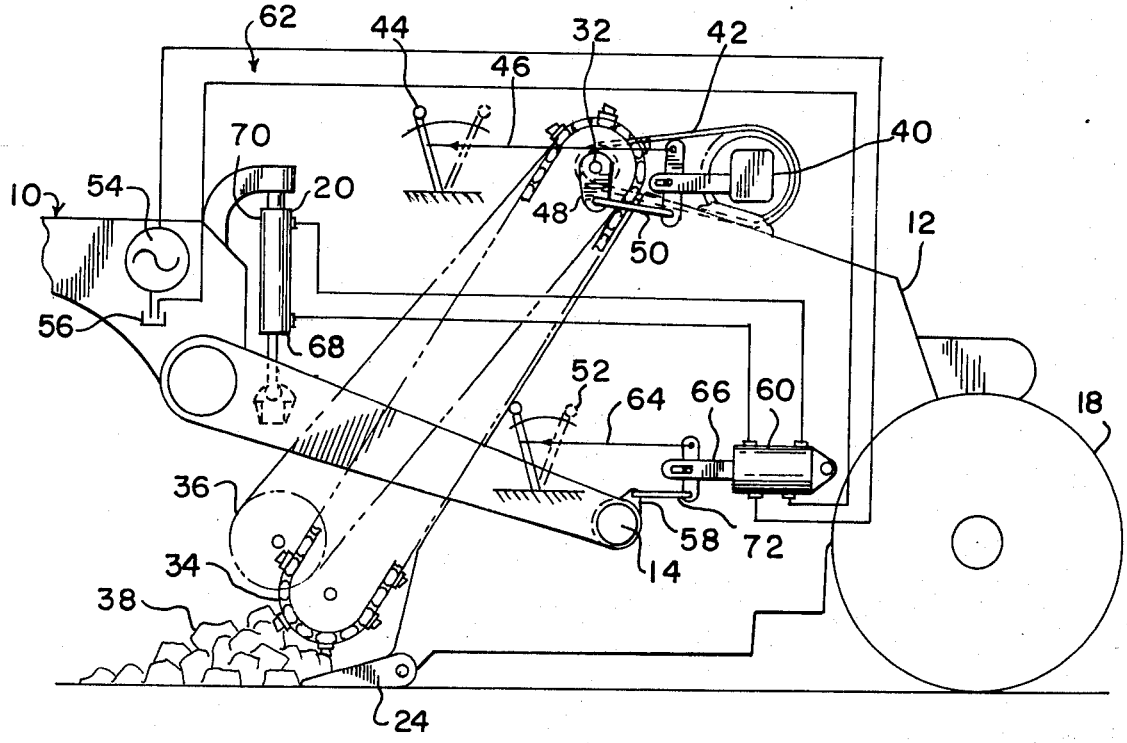
FIG. 2 is a schematic view of the elevator control system and the cutting depth control system for a fixed cutting blade scraper.
Figure 3:
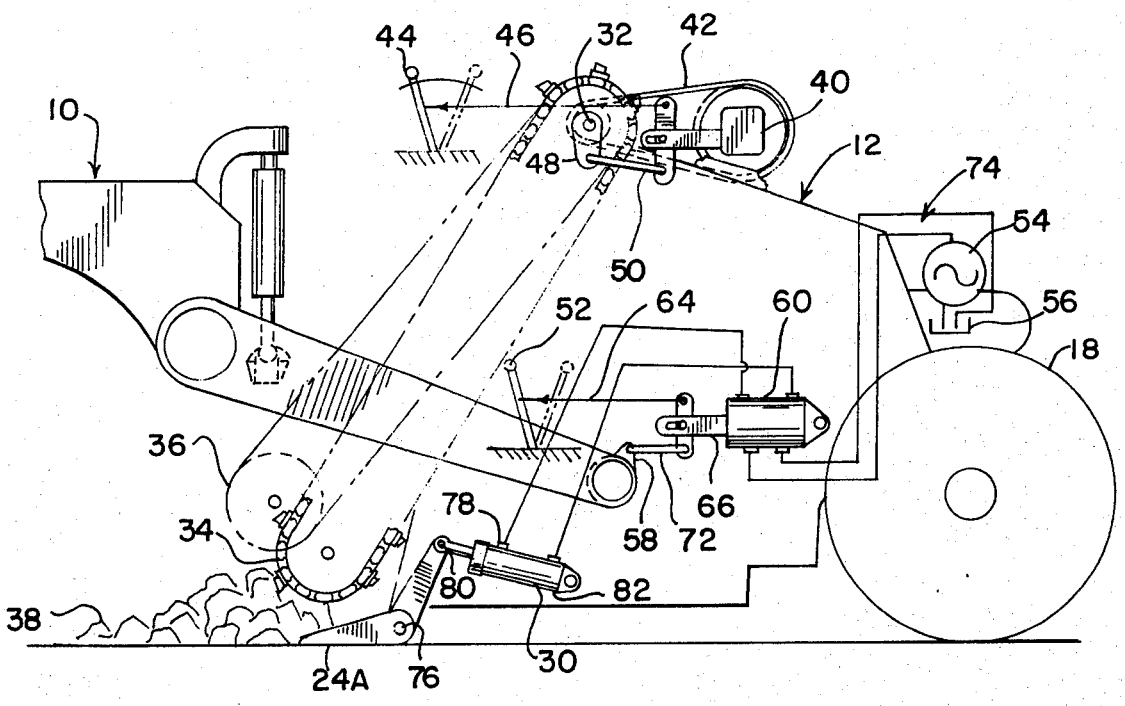
FIG. 3 is a schematic view of the elevator control system and cutting depth control system for an adjustable cutting blade scraper.

The preferred embodiments elevator control system is depicted schemmatically in FIGS. 2 and 3. In the illustrated embodiment the elevator is a conventional endless chain link type which is pivotally attached at point 32 to the bowl 12. The elevator is supported by a torsional member (not shown) which permits the elevator to move from position 34 to position 36 as the volume of separated material 38 in front of the blade 24 increases during the removal process. The power source for the preferred elevator is a variable speed drive motor 40 mounted on the bowl 12, connected to the elevator by chain 42 and operably connected to the engine 16. While the preferred embodiment incorporates a variable speed drive motor and chain, it will be apparent to those skilled in the art that alternative variable speed drive systems are within the scope of the invention.

Pursuant to the invention the operator sets the optimum drive speed of the variable speed drive motor 40 by selective positioning of the speed selector quadrant 44 which is mounted within the operator station 22.

The operator's choice of elevator speed is transmitted to the variable speed drive motor 40 by a linkage arrangement 46 connecting the variable speed drive motor 40 and the speed selector quadrant 44. When the operator has selected the optimum elevator speed for the given ground conditions, the pivotal motion of the elevator 28 is transmitted to a motion sensing lever 48 whose angular displacement about pivot 32 equals the angular displacement of elevator 28 about pivot 32. The motion of the lever 48 is transmitted to the drive motor 40 by the interaction of connector 50 and the linkage arrangement 46. During the scraping operation the speed of the variable speed drive motor will be increased as the volume of material 38 increases and forces the elevator 28 to move from position 34 to position 36.

In accordance with a further aspect of the invention the operator's station 22 is also equipped with a depth selector quadrant 52 which the operator uses to establish the optimum depth of the cutting blade 24. In the preferred form the depth selector quadrant 52 establishes the cutting depth by acting on either the hydraulic rams 20 which determine the position between the bowl 12 and a tractor 10 or by acting on the blade cylinder 30 which determines the angular position of an adjustable cutting blade 24A. The former arrangement is depicted in FIG. 2 which shows the scrapers variable displacement pump 54 and its oil reservoir 56 connected to the tractor 10. In the illustrated form a draft sensing device 58 is interposed between the tractor 10 and the bowl 12 at their pivotal axis 14. The draft sensing device 58 is one of the conventional arrangements which are used to measure variances in torque transmitted between connected elements. In carrying out the invention a control valve 60 is interposed in the conduit connection 62 between the variable displacement pump 54, the oil reservoir and the hydraulic jacks 20 which are in a float mode during the scraping operation. This control valve is connected to the depth selector quadrant 52 by a lever arrangement 64 which varies the position of the spool 66 within the control valve 60. The position of the spool 66 within the control valve 60 determines whether the rod end 68 or the head end 70 of the lift rams 20 is connected to the pump 54 with the opposite end being connected to the reservoir 56.

After the operator has used the depth selector quadrant 52 to establish the optimum cutting depth of the blade 24 and has continued to remove the soil by forward motion of the scraper, the variations in the cutting load acting on the blade 24 are transmitted through the bowl 12 to the draft sensing device 58. These variations are translated into rotational motion of the draft sensing device 58 with this motion being transmitted through a coupler 72 to the linkage arrangement 64. The hydraulic system of the preferred embodiment is arranged to have an increase in cutting load cause the rod end 68 of the hydraulic ram 20 to be connected to the pump with the head end 70 being connected to the reservoir. The arrangement causes the hydraulic ram 20 to be retracted thereby raising the bowl 12 with respect to the tractor 10 and decreasing the cutting depth of the blade 24. When the draft sensing device 58 rotates in the opposite direction as a result of a decrease in cutting load, a reverse hydraulic connection will be established which will lower the position of the scraper 12 with respect to the tractor 10 and increase the cutting depth of the blade 24.

The present invention is also concerned with a cutting depth control system which is applicable to a scraper having an adjustable cutting blade as depicted in FIG. 3. In this configuration the depth selector 52, the control valve 60, the pump 54, hydraulic jacks 20, and the reservoir 56 are identical to those described above except that the pump and reservoir are connected to the bowl rather than the tractor, and that they provide an automatic variation in the position of the blade cylinder. In the illustrated form the control valve 60 is interposed in the conduit 74 which connects the pump 54, the reservoir 56 and the blade cylinder 30. In carrying out the invention the adjustable blade 24A is pivotally attached to the bowl 12 at point 76 and is pivotally attached to the rod end 78 of the blade cylinder 30 at point 80. When the operator has set the depth selector quadrant 52 at the optimum cutting depth and continues to remove a layer of soil from the ground, the draft sensing device 58 acts on the lever arrangement 64 through the coupling 72 to alternatively connect the rod end 78 to the pump 54 and the reservoir 56 while connecting the head end 82 of the blade cylinder 30 to the reservoir 56 and the pump 54. The hydraulic arrangement of this embodiment increases the downward angle of the cutting blade 24A in response to a decrease in cutting load and decreases the downward angle of the cutting blade 24A in response to an increase in the cutting load.

From the foregoing, it will be seen that through the practice of this invention the operator is supplied with a method of automatically controlling the elevator speed and the cutting depth of the scraper, thereby freeing him for concentration on the steering, speed and other functions which he must perform from the operator station. As disclosed in the schemmatic representations of FIGS. 2 and 3, a scraper can be equipped with an elevator speed control system and a cutting depth control system, the combination of which will provide an automatic removal control system that will insure maximum efficiency in the scraping and loading processes.

Thus, it has been apparent that there has been provided in accordance with the invention, a removal control system for a scraper that is responsive to the cutting loads and/or the volume of material separated from the ground to insure efficient separation of the material and/or complete filling of the bowl. While the invention has been described in conjunction with specific embodiments thereof it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An elevator control system for a scraper having a tractor pivotally attached to a bowl, an engine and an elevator pivotally mounted on said bowl, said control system comprising, in combination:

variable speed drive means operably connected to said elevator and said engine for controlling the speed of said elevator;

motion sensing means responsive to said elevator's pivotal motion for varying the speed of said variable speed drive means;

a connector operably connecting said motion sensing means and said variable speed drive means;

speed selector means operably connected to said variable speed drive means for establishing the optimum speed of said elevator; and a linkage arrangement operably connecting said variable speed drive means and said selector means.

2. A removal control system for a scraper having a tractor pivotally attached to a bowl, said bowl having a cutting blade attached thereto, an engine and an elevator pivotally mounted on said bowl, said control system comprising in combination:

variable speed drive means operably connected to said elevator and said engine for controlling the speed of said elevator;

motion sensing means responsive to said elevator pivotal motion for varying the speed of said variable speed drive means;

a connector operably connecting said motion sensing means and said variable speed drive means;

speed selector means operably connected to said variable speed drive means for establishing the optimum speed of said elevator;

a linkage arrangement operably connecting said variable speed drive means and said selector means;

position control means operably connected to said engine and said cutting blade for establishing the cutting depth of said blade;

draft sensing means responsive to the cutting load on said scraper for varying the position of said position control means;

a coupling operably connecting said draft sensing means and said position control means;

depth selector means operably connected to said position control means for establishing the optimum cutting depth of said cutting blade; and a lever arrangement operably connecting said depth selector means and said position control means.

3. The removal control system of claim 2 wherein said position control means includes a hydraulic system controlling the relative position of said tractor to said bowl, and said draft sensing means includes a control valve which varies the flow in said hydraulic system in response to changes in the cutting load.

4. The removal control system of claim 2 wherein said blade is an adjustable cutting blade, said position control means includes a hydraulic arrangement for establishing the position of said adjustable cutting blade and said draft sensing means includes a control valve which varies the flow in said hydraulic arrangement in response to changes in the cutting load.

* * * * *